US005598776A

United States Patent [19]

Casl

[11] Patent Number: 5,598,776

[45] Date of Patent: Feb. 4, 1997

[54] SCREEN PRINTING APPARATUS

[75] Inventor: Slobodan Casl, Williamstown, N.J.

[73] Assignees: Sony Corporation, Tokyo, Japan; Sony Music Entertainment, Inc., New York, N.Y.

[21] Appl. No.: 493,031

[22] Filed: Jun. 21, 1995

[51] Int. Cl.[6] ..... B05C 17/08

[52] U.S. Cl. ..... 101/127.1; 101/128.1

[58] Field of Search ..... 101/127.1, 128.1, 101/128, 129, 128.4, 407.1; 403/DIG. 9

[56] References Cited

U.S. PATENT DOCUMENTS

| | | | |
|---|---|---|---|
| 3,233,358 | 2/1966 | Dehm | 446/128 |
| 3,289,220 | 12/1966 | Grimshaw | 101/127.1 |
| 3,908,293 | 9/1975 | Newman | 38/102.91 |
| 3,914,887 | 10/1975 | Newman | 38/102.8 |
| 3,962,805 | 6/1976 | Hamu | 38/102.5 |
| 4,134,340 | 1/1979 | Larson | 101/127.1 |
| 4,525,909 | 7/1985 | Newman | 29/121.1 |
| 4,539,734 | 9/1985 | Messerschmitt | 24/460 |
| 4,766,661 | 8/1988 | Croteau | 29/417 |
| 4,817,897 | 4/1989 | Kreusel | 403/398 |
| 4,860,467 | 8/1989 | Larson | 38/102.4 |
| 4,978,414 | 12/1990 | Ohtani et al. | 156/494 |
| 4,981,076 | 1/1991 | Cunill | 101/127.1 |
| 5,076,162 | 12/1991 | Goin | 101/127.1 |
| 5,096,524 | 3/1992 | Ohtani et al. | 156/160 |
| 5,127,176 | 7/1992 | Newman | 38/102.1 |
| 5,148,745 | 9/1992 | Hamu | 101/127.1 |
| 5,163,367 | 11/1992 | Newman | 101/127.1 |
| 5,220,867 | 6/1993 | Carpenter | 101/127.1 |
| 5,255,600 | 10/1993 | Hamu | 101/127.1 |
| 5,265,534 | 11/1993 | Hamu | 101/127.1 |
| 5,271,171 | 12/1993 | Smith | 38/102.5 |
| 5,327,828 | 7/1994 | Barocas et al. | 101/127.1 |
| 5,435,354 | 7/1995 | Vezzu | 403/DIG. 9 |

FOREIGN PATENT DOCUMENTS

| | | | |
|---|---|---|---|
| 3533269 | 9/1985 | Germany | 101/128.1 |
| 15469 | 8/1900 | United Kingdom | 403/389 |
| 921813 | 3/1963 | United Kingdom | 101/127.1 |

*Primary Examiner*—Edgar S. Burr
*Assistant Examiner*—Anthony H. Nguyen
*Attorney, Agent, or Firm*—Pasquale Musacchio; Jerry A. Miller

[57] ABSTRACT

A screen printing apparatus has a base frame 1 in the shape of a convex-rectangle, four, tensioning rods 2 attached a printing screen fabric 5, four pair of collars 4 and four pair of bearing blocks 3. The bearing blocks 3 are attached to the base frame 1 to hold the tensioning rods 2 in place. The tensioning rods 2 are rotated in a predetermined direction to increase tension of the printing screen fabric 5. The collars 4 lock the tensioning rods in place.

4 Claims, 2 Drawing Sheets

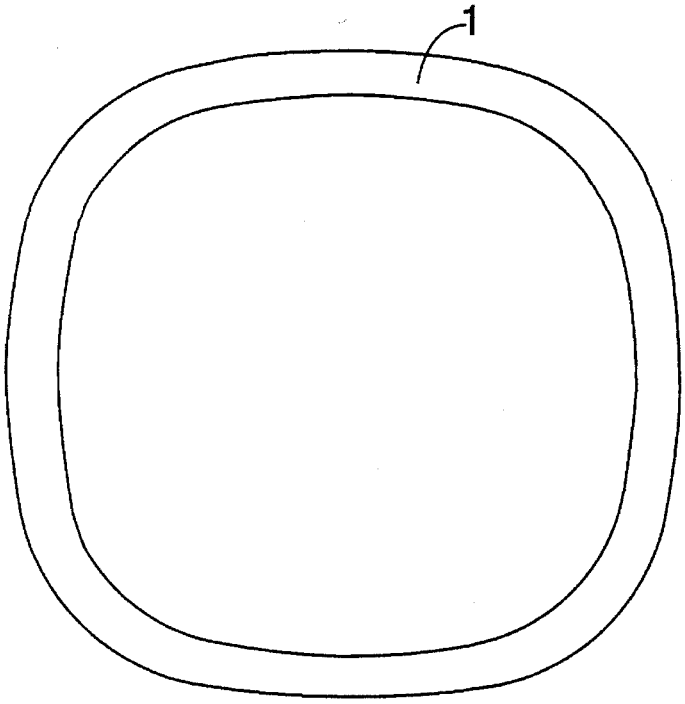
FIG. 3
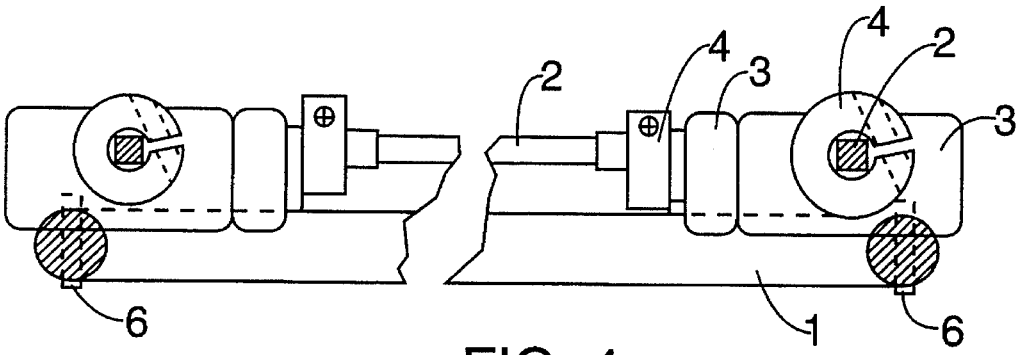
FIG. 4
FIG. 5
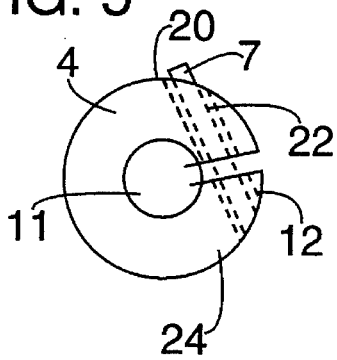
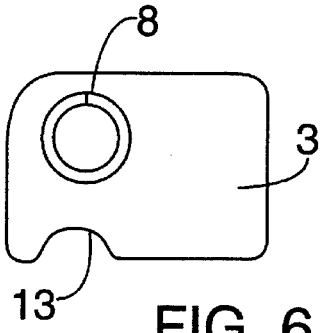
FIG. 6

SCREEN PRINTING APPARATUS

FIELD OF THE INVENTION

This invention relates to screen printing apparatus. More particularly this invention relates to tensionable frame for use in screen printing.

BACKGROUND

In screen printing, a frame is used to stretch a screen fabric which carries the artwork to be reproduced. The screen fabric should be stretched uniformly and with a predetermined high tension in a predetermined printing area to do precision printing. The recommended screen fabric tension level is approximately from 20 N/cm to 40 N/cm. A common problem with commercially available screen printing frames is loss of the predetermined tension in a short period of time while screen printing. Present screen printing frames also commonly do not allow the screen fabric to maintain a high level of uniform tension in the printing area such as the center of the screen fabric. For instance, when the corners of the screen fabric reach a high tension level such as 30 N/cm, the tension of the center area of the screen fabric is only 26 N/cm. Furthermore, it takes too much time to make the screen printing apparatus, and it is too complicated to use the screen printing apparatus.

SUMMARY OF THE INVENTION

One object of the present invention is to provide a new and improved screen printing apparatus which is tensionable.

Another object of the present invention is to provide a screen printing apparatus which can produce suitable high tension for precision screen printing of small object such as a compact disk.

Another object of the present invention is to provide a screen printing apparatus which is quick to make and simple to use.

Another object of the present invention is to provide a screen printing apparatus which is easily retensioned.

According to the present invention, a screen printing apparatus has a base frame in the shape of a convex-rectangle, a tensioning rod for attaching a printing screen and a locking device for keeping the tensioning rod in place. The tensioning rod is rotated in a predetermined direction to increase tension of the printing screen.

BRIEF DESCRIPTION OF THE DRAWINGS

FIG. 3 is a plan view showing a base frame of the screen printing apparatus.

FIG. 4 is a cross-sectional view of the screen printing apparatus.

FIG. 5 is a cross-sectional view of a collar used in the screen printing apparatus.

FIG. 6 is a cross-sectional view of a bearing block used in the screen printing apparatus.

DESCRIPTION OF THE INVENTION

A screen printing apparatus of the present invention will be explained, making reference to the drawings in which reference numbers represent similar elements throughout the several views.

Figure 1:
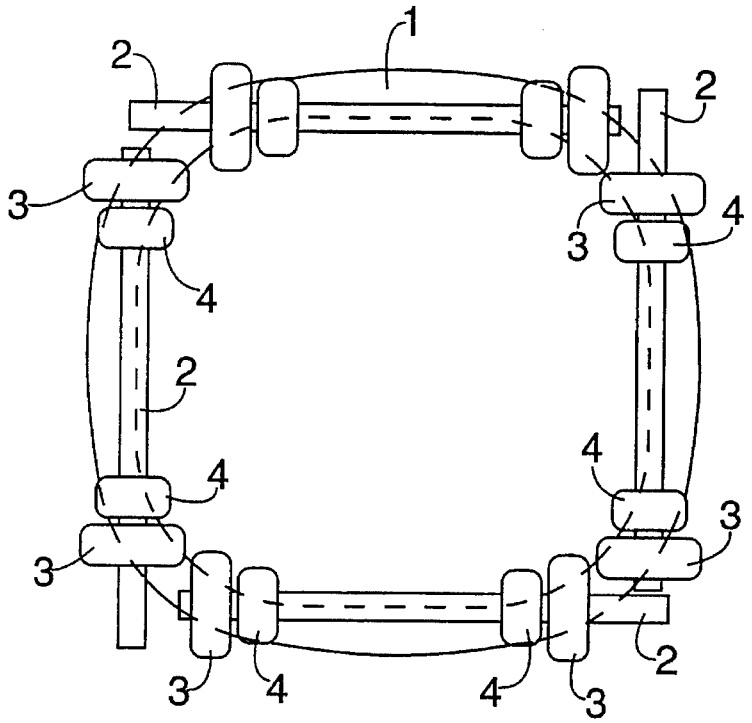
FIG. 1 is a plan view showing a screen printing apparatus of the present invention.

FIG. 1 is a plan view showing a screen printing apparatus of the present invention. The screen printing apparatus has a base frame 1, four tensioning rods 2, four pairs of bearing blocks 3 and four pairs of collars 4.

The base frame 1 is shown in FIG. 3. The base frame 1 is made of a rod of metal such as alumninum, steel and so on. Hardened steel or anodized aluminum is recommended for the base frame 1. A solid rod is preferable for the base frame 1. A hollow rod may not have enough strength during the stretching process. The convex-rectangle is the preferred shape for the base frame 1 so that a printing screen fabric 5 attached to the screen printing apparatus is placed under high tension in the center area which is approximately from 20 N/cm to 40 N/cm. Furthermore, the convex-rectangular shape allows the printing screen fabric 5 to have tight center and loose corners. This means that the printing screen fabric 5 can have a "sweet spot" 9 in the center area, which exhibits high tension which is good for precision screen printing. The base frame 1 is preferably made by welding a metal rod such as an aluminum rod. Though the base frame 1 does not have any restriction on size, an aluminum rod having a diameter of ½ inch is used as an embodiment in the present invention for screen printing compact discs.

Four pairs of bearing blocks 3 are respectively attached to the base frame 1 by welding or bolting or the like. Four pairs of collars 4 are respectively attached to the base frame 1 or the bearing blocks 3 by welding or bolting. Four tensioning rods 2 respectively go through the bearing block 3 and the collar 4 as shown in FIG. 1. The collar 4 is used to keep the tensioning rod 2 in place by preventing rotation of the tensioning rods 2 with respect to the base frame 1, when the collar 4 is tightened. The bearing block 3 is used to keep the tensioning rod 2 in place while allowing the tensioning rod 2 to rotate easily. Though the bearing block 3 and the collar 4 do not have any restrictions, a bearing block 3 having an inside diameter of ⅜ inch and a collar 4 having an inside diameter of ⅜ inch are used as an embodiment in the present invention. In this embodiment, the outside diameter of the tensioning rod 2 is ⅜ inch. The tensioning rod 2 has flats at the sides of both ends so that it can be rotated by a wrench. Those skilled in the art will recognize other mechanisms for grasping the tensioning rods 2 and locking the tensioning rods 2.

Figure 2:
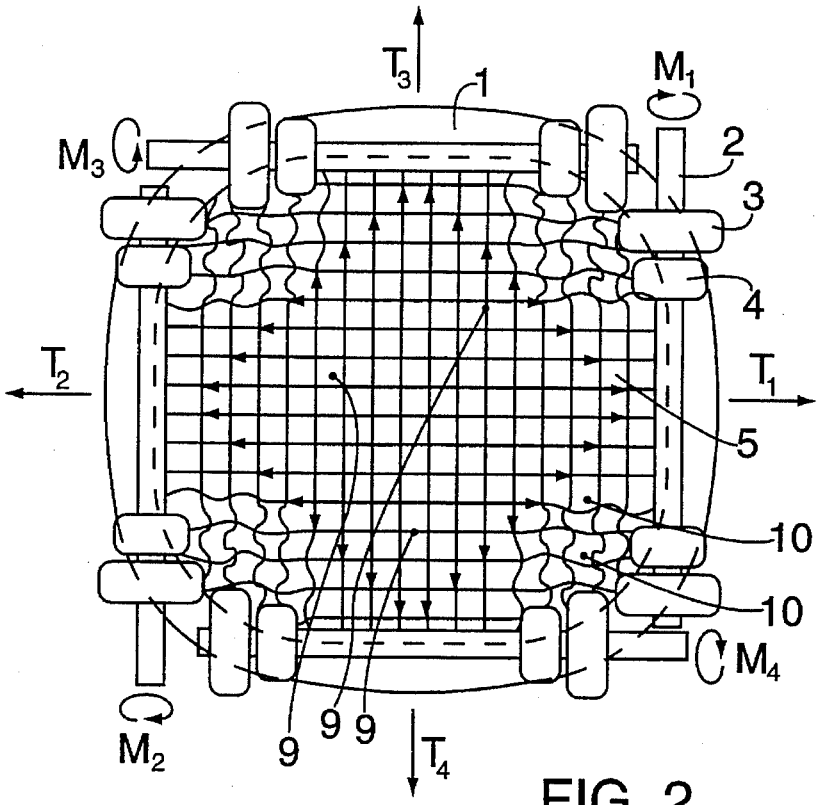
FIG. 2 is a plan view showing a screen printing apparatus attaching a printing screen fabric thereto of the present invention.

FIG. 2 shows the principle of the present invention. At first, a screen printing screen fabric is stretched to a desired tension level in accordance with the following process. A screen printing screen fabric is attached to the four tensioning rods 2, for example by glue, tape or the like. In this embodiment, the printing screen fabric is attached to the low side of the tensioning rod 2. Therefore when the tensioning rod 2, placed at the right side of FIG. 2, is rotated in the direction of $M_l$ with a wrench and/or the tensioning rod 2 placed at the left side of FIG. 2 is rotated in the direction of $M_2$, the tension of the printing screen fabric 5 in the direction of abscissa axis is increased. In the same manner, when the tensioning rod 2 placed at the upper side of FIG. 2 is rotated in the direction of $M_3$ with a wrench and/or the tensioning rod 2 placed at the lower side of FIG. 2 is rotated in the direction of $M_4$, the tension of the printing screen fabric 5 in the direction of ordinate axis is increased. The center area called "sweet spot" 9 of the printing screen fabric 5 has the highest tension and provides the best area for screen printing. The corner 10 of the printing screen fabric 5 has very little or virtually no tension.

In another embodiment, the printing screen fabric is attached to the upper side of the tensioning rod 2. Therefore when the tensioning rod 2 placed at the right side of FIG. 2 is rotated in the opposite direction of $M_1$ with a wrench and/or the tensioning rod 2 placed at the left side of FIG. 2 is rotated in the opposite direction of $M_2$, the tension of the printing screen fabric in the direction of abscissa axis is increased. In the same manner, when the tensioning rod 2 placed at the upper side of FIG. 2 is rotated in the opposite direction of $M_3$ with a wrench and/or the tensioning rod 2 placed at the lower side of FIG. 2 is rotated in the opposite direction of $M_4$, the tension of the printing screen fabric in the direction of ordinate axis is increased.

After the screen printing screen fabric is stretched to the desired tension level, photo emulsion is coated on the screen printing fabric 5. A film is placed on the screen printing screen fabric 5 and the image from the film is transferred to the printing screen printing screen fabric 5 via exposure light. Thus, the screen printing screen fabric 5 is ready/or screen printing objects such as compact discs.

For multicolor prints, every color is printed with its own individual screen. Therefore, if five colors are printed to an object, five screen printing apparatuses will be prepared by stretching each screen printing fabric to the desired tension level on each screen printing apparatus.

The tension of the screen printing screen fabric 5 gradually decreases with each use over time. The tension drop of the screen printing fabric causes registration problems wherein the screens cannot be properly aligned. Therefore, the screen printing screen fabric 5 is retensioned so as to correct the registration problem. The retensioning is performed by rotating the tensioning rod 2 again.

FIG. 5 is a cross-sectional view of a collar 4 used in the screen printing apparatus. The collar 4 has a hole 11 on the center for receiving the tensioning rod 2. The collar 4 is C-shaped having a top portion 20 which includes a through hole 22 for receiving a bolt 7 having a shoulder which is adapted to abut against a shoulder portion (not shown) of through hole 22. The collar 4 further includes a spaced apart lower section 24 having a threaded hole 12 for threadably engaging bolt 7. After the tensioning rod 2 is put into the collar 4, the bolt 7 is screwed to tighten the collar 4 and prevent the tensioning rod 2 from rotating. The collar 4 is attached to the bearing block 3 or the base frame 1 so that when tightened around the tensioning rod 2, the tensioning rod 2 will not rotate in relation to the collar 4 and thus the bearing block 3.

FIG. 6 is a cross-sectional view of a bearing block 3 used in the screen printing apparatus. The bearing block 3 has a hole 8 for receiving the tensioning rod 2. The bearing block 3 has a recess 13 so that the base frame 1 is placed in the recess 13.

FIG. 4 is a cross-sectional view of the screen printing apparatus. The bearing block 3 is attached to the base frame 1 by welding or bolting or the like. This embodiment shows that the bearing block is attached to the base frame by a bolt 6.

Thus, a fabric attached to the screen printing apparatus of the present invention has a "sweet spot", which has high enough tension for precision screen printing. Furthermore, if the tension of the screen printing fabric drops during screen printing and loses the required high tension, the screen printing fabric is easily retensioned. So the screen printing apparatus allows the fabric to maintain a good screen printing quality. Furthermore, because the structure of the screen printing apparatus is simple, it is easy to make and use the screen printing apparatus.

While the present invention has been described in terms of preferred embodiments thereof, those skilled in the art will understand that several variation can be made without departing from the present invention. For example, rather than providing a flat area on the end of the tensioning rod 2 to accommodate a wrench, a hole or a slot could be provided to receive a spanner wrench or simple rod. Similarly, a handle could be affixed to the end of tensioning rod 2. The exact shape of base frame 1 could be modified as required, with strength in the base frame 1 being provided otherwise. Furthermore, instead of providing a collar, other arrangements for keeping the rod in place could be devised.

Thus it is apparent that in accordance with the present invention, a method and apparatus that fully satisfies the objectives, aims and advantages is set forth above. While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

What is claimed is:

1. A screen printing apparatus for tensioning a printing area within a printing screen comprising:

a base frame having an upper curved section spaced apart from a lower curved section and a left curved section spaced apart from a right curved section, wherein said upper and lower curved sections and said left and right curved sections extend outward from each other, respectively, to form a substantially rectangular shape having convex sides;

upper, lower, left and right tensioning rods positioned adjacent said upper, lower, left and right convex sections, respectively, wherein said upper tensioning rod is positioned substantially parallel to said lower tensioning rod and said left tensioning rod is positioned substantially parallel to said right tensioning rod such that said upper, lower, left and right tensioning rods form a substantially rectangular shape and wherein said upper, lower, left and right tensioning rods are adapted for attachment of said printing screen;

locking means for keeping said upper, lower, left and right tensioning rods in place; and holding means for enabling rotation of said upper, lower, left and right tensioning rods wherein said upper, lower, left angle right tensioning rods are selectively rotated in a predetermined direction to increase tension in said printing area.

2. A screen printing apparatus according to claim 1, wherein said locking means includes a collar.

3. A screen printing apparatus according to claim 1, wherein said upper, lower, left and right tensioning rods each include flats at ends thereof.

4. A screen printing apparatus according to claim 1, wherein said locking means is attached to said base frame.

* * * * *